US006922957B2

(12) United States Patent
Saelzer

(10) Patent No.: US 6,922,957 B2
(45) Date of Patent: Aug. 2, 2005

(54) BUILDING CLOSURE, SUCH AS A DOOR OR WINDOW, CONSTRUCTED TO RESIST AN EXPLOSIVE BLAST

(75) Inventor: Heinrich Saelzer, Marburg (DE)

(73) Assignee: Saelzer Sicherheitstechnik GmbH, Marburg (DE)

( * ) Notice: Subject to any disclaimer, the term of this patent is extended or adjusted under 35 U.S.C. 154(b) by 51 days.

(21) Appl. No.: 10/434,806

(22) Filed: May 8, 2003

(65) Prior Publication Data

US 2003/0208970 A1 Nov. 13, 2003

(30) Foreign Application Priority Data

May 8, 2002 (DE) ..... 102 20 832

(51) Int. Cl.[7] ..... E04B 1/98

(52) U.S. Cl. ..... 52/204.1; 52/167.1; 52/204.599; 52/656.5

(58) Field of Search ..... 52/167.1, 204.1, 52/204.5, 204.55, 204.599, 656.2, 656.4, 656.5, 656.7; 49/504

(56) References Cited

U.S. PATENT DOCUMENTS 3,364,641 A * 1/1968 Brenneman ..... 52/573.1
4,625,659 A * 12/1986 Saelzer ..... 109/49.5
4,676,026 A * 6/1987 Schreiner ..... 49/501
5,950,380 A * 9/1999 Pearson ..... 52/204.5
6,216,401 B1 * 4/2001 Emek ..... 52/204.5
6,334,283 B1 * 1/2002 Edger ..... 52/204.1
6,509,071 B1 * 1/2003 Emek ..... 428/34
2003/0159376 A1 * 8/2003 Hunyh ..... 52/208

FOREIGN PATENT DOCUMENTS

| | | |
|---|---|---|
| DE | 3705401 | 9/1988 |
| DE | 3744816 | 9/1988 |
| GB | 2201183 | 8/1988 |

* cited by examiner

*Primary Examiner*—Brian E. Glessner
(74) *Attorney, Agent, or Firm*—W. F. Fasse; W. G. Fasse

(57) ABSTRACT

An opening in a building wall is closed by a building closure such as a window or door. A mounting part of the closure arrangement is received in a space between two countersupport surfaces formed by a U-channel or opposite L-members that protrude perpendicularly from the sill or jamb surface of the wall bounding the opening. Mounting brackets secure the U-channel or L-members to the wall. On one or both sides, a respective damping element is interposed between the mounting part and the respective adjacent countersupport surface. The damping element may be a plastically deformable metal strip. When an explosion force acts on the closure arrangement, the damping element is first plastically deformed to absorb energy, before the remaining force is transmitted into the building wall. The two damping elements on opposite sides damp forces from the positive and negative pressure waves of the explosion.

26 Claims, 7 Drawing Sheets

BUILDING CLOSURE, SUCH AS A DOOR OR WINDOW, CONSTRUCTED TO RESIST AN EXPLOSIVE BLAST

PRIORITY CLAIM

This application is based on and claims the priority under 35 U.S.C. §119 of German Patent Application 102 20 832.8, filed on May 8, 2002, the entire disclosure of which is incorporated herein by reference.

FIELD OF THE INVENTION

The invention relates to a building closure, such as a door or window, that is constructed to resist and thereby withstand and retard an explosive blast. The building closure generally includes a filler panel surrounded and supported by frame elements, which are connected in a force-transmitting manner to the sill or jamb surface of an opening in the wall of a building. At least one damping element is provided to achieve a damping effect when an explosive blast pressure is exerted on the building closure panel.

BACKGROUND INFORMATION

In the present application, the term "building closure" generally refers to windows and doors of a building, but also other types of flat or surfacial closure elements, such as facade elements, for example, which cover or close a wall of a building. Windows refer to both openable as well as fixed windows, while also referring to windows having transparent or translucent glazing panels as well as those having opaque or non-transparent filler panels.

Accordingly, the frame elements of the building closures in the context of the present application include a closure panel frame that is connected in a force-transmitting manner to the panel or panels of the closure, as well as a sill frame or jamb frame connected in a force-transmitting manner to the sill or jamb surface of the building wall that bounds the opening that is to be closed by the building closure. In the case of an openable building closure in the form of an openable window or door, the frame elements thus include the shanks or stiles and rails of the fixed frame, e.g. the jamb or sill frame secured to the building opening, as well as the shanks or stiles and rails of the movable frame, e.g. the panel, sash or wing frame, that is movably arranged and supported within the fixed frame. Alternatively, in the case of a rigid, fixed or non-openable building closure, the frame elements may make up a single fixed frame that is connected with the filler panel or panels on the one hand, and with the jamb or sill of the building opening on the other hand. The terms "jamb" and "sill" are intended as merely exemplary, without limitation to vertical and horizontal components, and should be understood generally as referring to all of the boundary surfaces of the wall that bound the opening and extend between the two opposite major surfaces of the wall. In other words, the description herein also applies in the context of interchanging the words "jamb" and "sill".

A building closure of the above described general type is, for example, known from the basic reference in this field, German Patent DE 37 05 401. In the known construction of a building closure, a web extends from the middle area of the boundary surface (e.g. the sill or jamb surface) of the building opening. Particularly, the web is formed by essentially rectangular-shaped profile members, which are rigidly connected with the masonry structure, e.g. a masonry wall, forming the sill or jamb. Two flanges in the manner of a fixed jamb frame of this building closure on the one hand protrude beyond the two surface planes of the filler panel or panels, and on the other hand overlap, respectively by about half of their length, both the above described central web as well as the filler panel itself. Screws extend from one flange through bored holes in the middle web to the other flange, and at their ends, are respectively connected with a pressure plate, which is respectively braced via an elastic damping element against the associated inner side of the fixed jamb frame flange which is embodied as a hollow profile or sectional member.

In the event a pressure acts on the filler panel, the arising force is transmitted through the pressure plate that is arranged on the side opposite the side of pressure impingement, then through the screws as a tension force, and then through the pressure plate arranged on the side of pressure impingement, into the bordering damping element, and from this damping element via a flange wall into the middle or central web. Thus, the arising force acts on the central web only in a reduced or diminished manner. In a similar manner, but in the opposite direction, the force arising from a pressure impinging in the opposite direction onto the filler panel, e.g. in the case of a reflection of the explosive positive pressure wave, is also only introduced into the central web, and thus into the building opening sill or jamb, in a diminished or weakened manner.

It could be said, however, that the known construction suffers the disadvantage that it requires a rather large dimension of the fixed jamb frame in a direction perpendicular to the plane defined by the filler panel. Thus, the fixed jamb frame has a thick or protruding appearance. Moreover, the fixed jamb frame cannot be embodied in a one-piece manner, because, to facilitate the installation, at least one flange can only be connected with the remaining building closure during the installation. Furthermore, the construction disclosed in German Patent DE 37 05 401 is not directly suitable for use in connection with a pivoting openable building closure having a movable panel frame swingably supported in the fixed jamb frame.

German Patent 37 44 816 C2 discloses a further building closure construction, wherein the fixed jamb frame of an immovable filler panel is arranged in front of a column or a separating wall of a building structure. In this context, sections of the jamb frame are braced or supported via damping elements against the oppositely located counter-support or abutment surface of the column. The resistive elements are embodied as plastically deformable, zig-zag shape bent metal sheets or similarly plastically deformable pipe sections arranged in rows adjacent to one another.

This previously known construction according to DE 37 44 816 is also not directly suitable for use in connection with a movable panel or sash frame that is pivotally or tiltably supported in a fixed jamb frame. Also in view of aesthetic considerations, this known construction is not acceptable, because the planes defined by the filler panel surfaces are all arranged in front of the furthest protruding plane of the wall or portion of the building bounding the opening.

SUMMARY OF THE INVENTION

In view of the above, it is an object of the invention to provide a building closure that is embodied in a manner to resist and thereby to withstand and retard an explosive blast, whereby the particular construction can be arranged within the depth or thickness of the opening that is to be closed, and can be economically produced, and can be installed without great effort, expense, or difficulty. Furthermore, the inventive construction of the building closure shall be able to withstand the greatest possible pressures impinging thereon. The invention further aims to overcome the disadvantages of the prior art, and to achieve additional advantages, as apparent from the present specification.

The above objects have been achieved according to the invention in a building closure that has been further developed and improved in comparison to the basic prior art discussed above. The building closure arranged in the opening of a building basically comprises at least one filler panel, frame elements that carry and extend at least partially around the perimeter of the filler panel, countersupport or abutment surfaces that are connected in a force-transmitting manner to the boundary surface (e.g. the sill or jamb surface) of the building opening, and at least one damping element arranged between at least one of the frame elements and at least one of the countersupport or abutment surfaces. The countersupport or abutment surfaces are located and arranged along the boundary surface within the thickness range of the wall between the opposite major wall surfaces of the wall, and extend perpendicularly relatively to the boundary surface.

Furthermore, preferably at least one damping element is respectively arranged on each one of the opposite sides of the frame elements between mutually facing countersupport surfaces. These two opposite damping elements achieve a damping effect in opposite directions by plastically deforming when respective forces are applied to the building closure in opposite directions.

More particularly, the invention is directed to an explosion resistant closure arrangement of a building closure in an opening of a wall of a building, comprising:

an opening in a wall of a building, wherein the opening is bounded by a boundary surface being a jamb or sill surface of the wall spanning between first and second major wall surfaces of the wall;

a mounting arrangement that is connected to the wall in a force transmitting manner and that includes first and second countersupport surfaces, wherein the countersupport surfaces are located along the boundary surface within a thickness range of the wall between the first and second major wall surfaces of the wall, wherein the first countersupport surface is arranged closer to the first major wall surface and faces toward the second major wall surface and the second countersupport surface is arranged closer to the second major wall surface and faces toward the first major wall surface, and wherein a receiving space is formed between the first and second countersupport surfaces;

a building closure that is received in the opening, and that comprises a filler panel and a frame arrangement extending along lateral edges of and carrying the filler panel, wherein the frame arrangement includes a mounting part that is received in the receiving space between the first and second countersupport surfaces; and a first damping element arranged in the receiving space between the mounting part and the first countersupport surface, wherein the first damping element is deformable and is free to deform in the receiving space so as to damp a first force that may act on the building closure and be transmitted from the frame arrangement through the first damping element to the first countersupport surface and thence to the wall.

According to the invention, beginning from a jamb frame construction of a conventional type, the two opposite countersupport or abutment surfaces that face toward each other make it possible to achieve very good explosive blast resisting properties, whereby simultaneously the structural complexity and expense is relatively low and the assembly and installation is relatively easy. It is not necessary, as it is in the German Patent DE 37 05 401 for example, that flanges of the jamb frame enclose a central web that is rigidly connected with the sill or edge of the opening. To the contrary, it is a general characteristic of the preferred embodiment of the present invention, that a part of the jamb frame extends into a groove-shaped recess or area of the sill that bounds the opening, whereby portions of the sill bound the two opposite sides or edges of this groove-shaped recess. These two opposite sides of the groove-shaped recess form the countersupport or abutment surfaces and serve to introduce the arising forces into building components, e.g. the masonry wall of the building, in the event of a force being applied to the building closure.

Advantageously, the countersupport or abutment surfaces can be subsequently installed or retrofitted in previously existing openings of an existing building. Thus, it is not necessary that the groove-shaped recess or channel is flushly recessed into the sill of the building opening, but instead can be formed by securing appropriate U-section or L-section profile members onto the existing window or door sill or jamb surface. Throughout this disclosure, the term "sill" generally refers to any boundary of an opening of a building, e.g. the side, top or bottom boundaries of a door opening or a window opening or the like, which may be formed by finished or unfinished surfaces of an opening in a wall, or by boundary components mounted thereon.

A further advantage of the building closure according to the invention is that the filler panel and all portions of the frame elements can be arranged or received within the range of the maximum thickness of the sill of the building opening. In other words, contrary to the arrangement according to German Patent DE 37 44 816, no components of the inventive arrangement protrude beyond or need to be braced against surfaces laterally outwardly displaced from the sill of the opening. It is also possible to incorporate or retrofit the inventive features onto sill or jamb frames starting with a conventional construction, whereby it is simply necessary to additionally provide, for example, a spring-elastic protruding side element that reaches and engages into the groove formed by the countersupport or abutment surfaces in the installed condition of the inventive building closure.

In a preferred arrangement for supporting the building closure, the countersupport or abutment surfaces are formed by the mutually facing opposite flange surfaces of a U-sectional profile member. This embodiment is very well suited to being retrofitted onto existing building openings, so as to provide such an existing building with explosion resistant doors or windows.

Alternatively, the countersupport surfaces can be formed by segments of an L-sectional profile member which are arranged in a row along the longitudinally extending direction of the associated frame element, while being alternately oriented in opposite directions. In other words, successive ones of the L-sectional profile member segments are alternately arranged with the L-shank on the right side or on the left side in succession. In this case, the installation is especially easy, because it is very simple to secure the L-profile segments to the existing window or door sill, whereby a "groove" or "channel" is essentially formed by the oppositely oriented successive segments of the L-profile members. In this case, there is no continuous countersupport surface in the form of a continuous side wall of a grooved sill, but rather a countersupport of the frame element is achieved alternately on the one side and on the other side of the web-like portion of the frame element or elements arranged and received between the protruding L-shanks of the alternating successive L-profile members.

A further possibility for supporting the building closure is that one countersupport surface is formed by a protruding shoulder of the sill of the opening, and cooperates with the allocated oppositely located countersupport surface that is formed by a profile or sectional member connected to the sill. This variant is especially applicable when, for example, an outer facing, trim or sheathing, for example a brick facing is provided on the outer side of a building facade, whereby this brick wall facing protrudes inwardly into the clear open area of the window opening beyond the actual window sill. Thereby, the window closure arrangement can be pushed from the interior of the building into the opening until the frame elements of the building closure rest or stop against the protruding shoulder. In this case, it is simply necessary to fix or secure the frame elements from the inside, for example using an L-sectional profile or any other desired profile member or hollow sectional member.

In order to securely, yet simply anchor the U-sectional or L-sectional profile members that form the countersupport surfaces, these profile members can be connected with mounting or holding brackets, for example by being welded, screwed or bolted to the mounting brackets. The mounting brackets, in turn, are anchored by securing elements such as bolts and bolt anchors, for example, in bored holes provided in the building wall or other building component bounding the opening.

An especially effective and reliable damping arrangement that provides the required energy absorption over the displacement distance thereof comprises damping elements in the form of sheetmetal strips that extend longitudinally along the lengthwise direction of the associated frame element of the building closure. When a force is applied laterally to these sheetmetal strip damping elements, they are preferably plastically deformed by plastic bending, to thereby achieve the damping and energy absorption effect. Alternatively, the sheetmetal strips can have an elastic spring characteristic, so that the strips are elastically flexed before or in addition to being plastically deformed, whereby the elastic flexing dissipates some energy and stores some energy which is then released as the damping element flexes back after the incident force is removed.

It is preferred and recommended according to the invention, not only to provide damping elements in an arrangement that is effective for absorbing and damping energy in response to a force introduction in a principle explosive impact direction, but rather also to provide damping elements that are effective for the opposite force application direction. Namely, in the event of a detonation of an explosive near the inventive building closure provided in a building, there is a positive pressure wave that will apply the principle pressure load onto the exterior of the building closure. This exerts a principle force in a direction from the outside to the inside of the building. However, when the pressure wave impacts on the building closure and then reflects therefrom, a reduced pressure will arise on this principle load side, which results in a negative force being applied to the exterior of the building closure, i.e. a force acting contrary to the above described principle force direction, and thus tending to pull the building closure from the inside to the outside. According to the invention, damping elements are preferably arranged to be effective with respect to both of these oppositely directed forces.

A preferred embodiment for the damping elements that are effective in both force application directions involves a sheetmetal strip that is divided into three zones in its cross-sectional configuration, namely a central zone that is secured to the associated frame element of the building closure, and two opposite edge or rim zones that are supported against the respective countersupport surfaces and that are plastically deformable so as to achieve the damping and energy absorption in the respective associated opposite directions. Particularly, the sheetmetal strip may have a bowl or trough-shaped cross-section, with angled or obliquely sloping side surfaces that protrude toward and against the countersupport surfaces, and a central zone that is tightly clamped or held against an allocated contact surface of the respective frame element by a corresponding securing profile member.

The invention further provides special features for achieving a reliable and robust force introduction from the building closure into the building wall or other building components that bound the opening in which the closure is arranged, especially in situations of a relatively weak building wall or other building components, such as old masonry walls or walls made out of hollow bricks or masonry blocks. In such walls, an adequate and reliable force introduction cannot be achieved with a point-wise connection and force introduction through individual bolts and bolt anchors. Instead, the invention provides right-angled brackets secured to the frame elements on at least two opposite sides of the building closure. Each one of the right-angled brackets includes a tension shank or web that runs along or near the sill of the opening, and a support shank that extends at a right angle from the tension shank and lies against the exterior side surface (or alternatively the interior side surface) of the building wall or other building component that bounds the opening.

In comparison to securing means such as expansion bolts, dowels, or bolt anchors, which provide a more or less point-wise force introduction into the wall, the inventive force introduction surface provided by the above mentioned brackets achieves a distributed force introduction over a large surface area of the building wall or the like. Also, this force introduction area can easily be enlarged to the required size, so that the danger of the building closure becoming loose, ripping out, or being pressed into the building opening is reliably excluded, even in connection with masonry walls or other walls that have a relatively low load bearing capacity. The number of these brackets and their particular dimensions can be selected or adjusted depending on the actual requirements of a particular application. It is also possible to provide respective support shanks on both opposite ends of the brackets, to achieve a supporting and force introduction both on the interior side as well as the exterior side of the building. In this manner, the forces arising both from the positive pressure wave as well as from the negative pressure wave can be reliably and surely taken up and introduced into the building wall or the like.

BRIEF DESCRIPTION OF THE DRAWINGS

In order that the invention may be clearly understood, it will now be described in detail in connection with several example embodiments thereof, which are illustrated in the accompanying drawings, wherein.

DETAILED DESCRIPTION OF PREFERRED EXAMPLE EMBODIMENTS AND OF THE BEST MODE OF THE INVENTION

Figure 1:
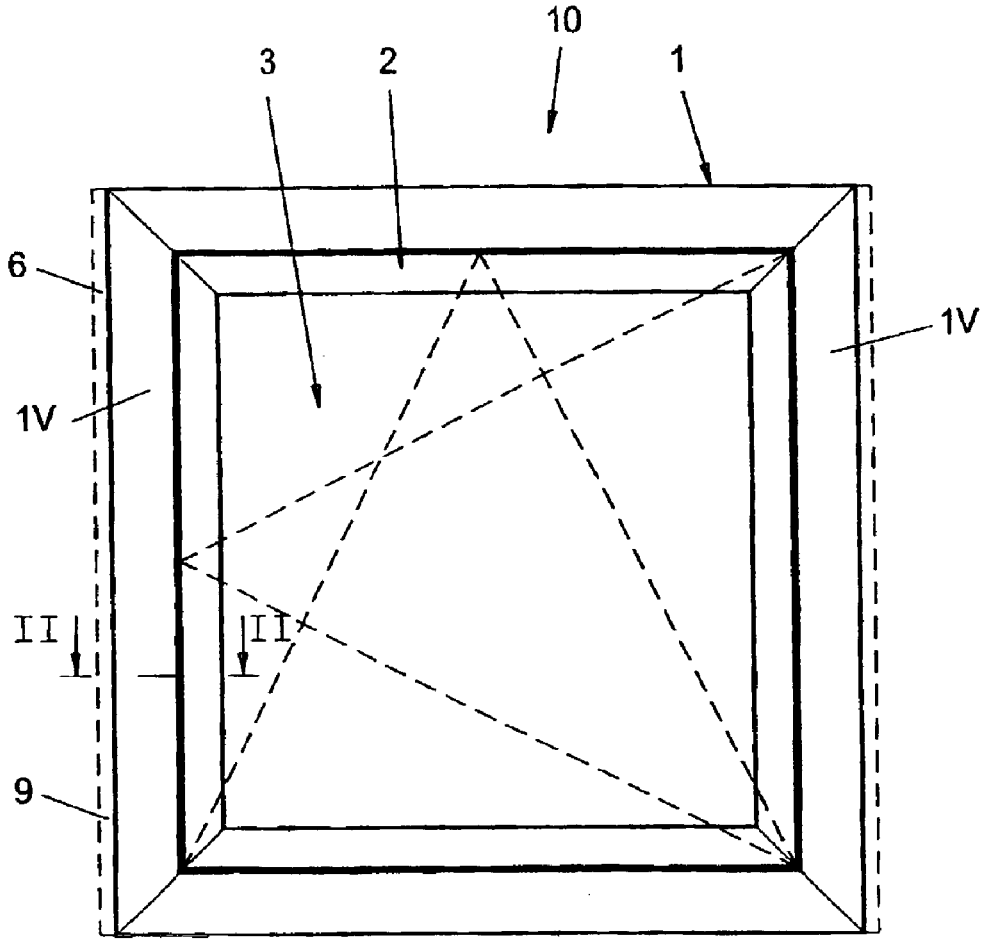
FIG. 1 is an exterior elevation view of an explosion resistant window as an exemplary building closure according to the invention, including a fixed jamb frame, a movable panel or sash frame that is pivotably or tiltably supported in the fixed jamb frame, as well as a glass filler panel arranged in the movable sash frame.
Figure 2:
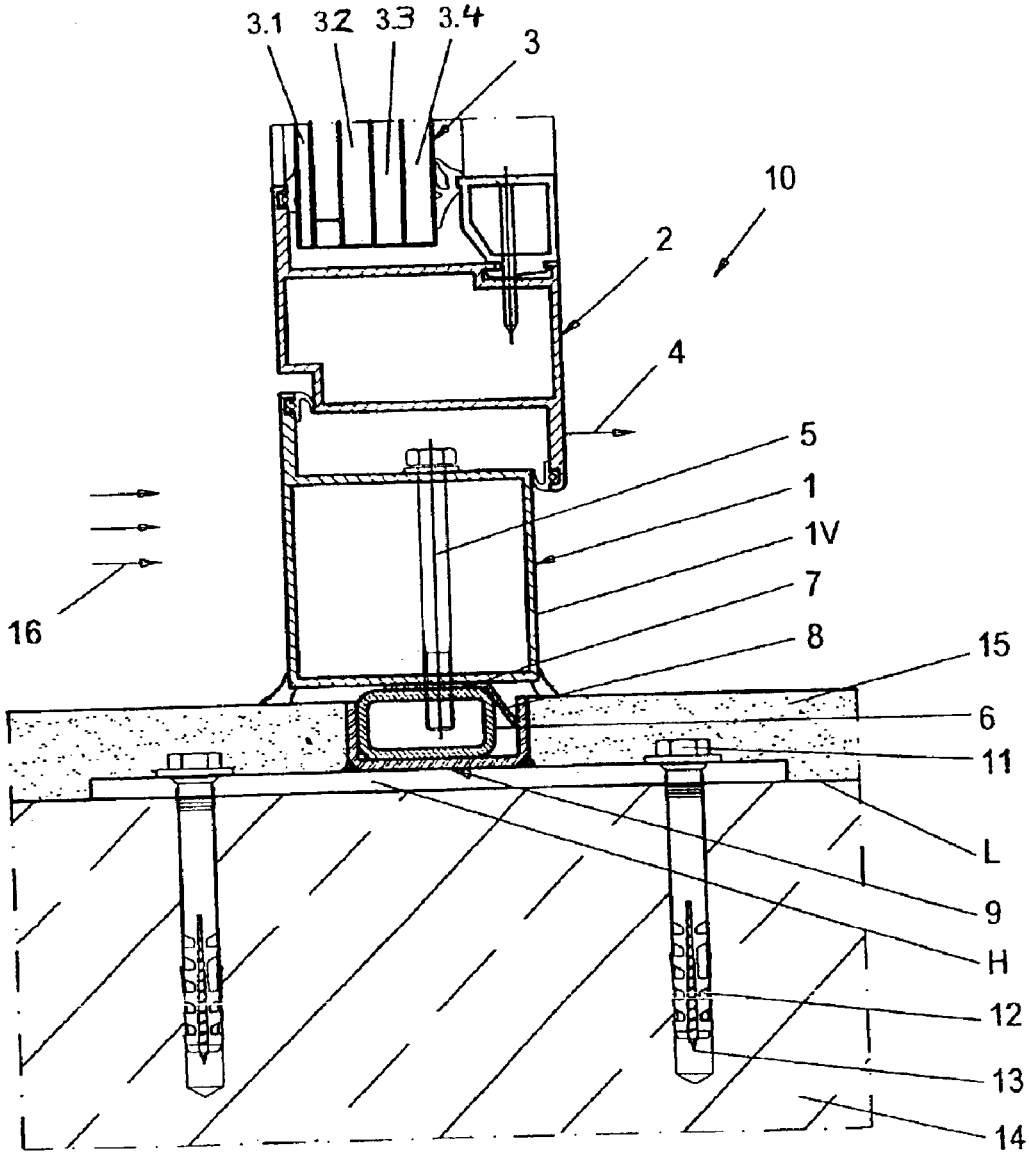
FIG. 2 is a cross-section along the section line II—II through the frame elements and the area of the connection of the frame elements to the window jamb surface of the building closure arrangement according to FIG. 1.

A building closure arrangement 10 shown in FIGS. 1 and 2 is particularly embodied as an explosion resistant window arrangement 10 that is secured in an opening of a building facade, e.g. a building wall, so as to close the opening. The building closure arrangement or window arrangement 10 comprises a fixed jamb frame 1 that is secured to the boundaries of the building wall that bound the opening, a movable sash frame 2 that is pivotably or tiltably supported in the fixed jamb frame 1, as well as a filler panel 3 that is held and carried by the sash frame 2. The filler panel 3, for example, is a high pressure resistant bulletproof glass arrangement including four individual layers 3,1, 3.2, 3.3 and 3.4 of bulletproof glass panes. The structure and the cooperative arrangement of the bulletproof glass filler panel 3, the movable sash frame 2, and the fixed jamb frame 1, relative to each other, can be according to any conventionally known teachings. Therefore, these features are not described in further detail herein. Through the conventional interconnection of the movable sash frame 2 with the fixed jamb frame 1, the sash frame 2 and its filler panel 3 can be pivoted or tilted in the direction of arrow 4 into the interior of the building.

The vertical shanks or stiles 1V of the fixed jamb frame 1 are respectively segments of a substantially right-angled sectional profile member consisting of aluminum, for example. A rectangular sectional member or tube 6 forms a mounting part and is connected by threaded screws or bolts 5 to the laterally outer side of the vertical shanks or stiles 1V. A damping element 7 is received and held between the mounting part, i.e. the rectangular sectional tube 6, and the shank 1V of the fixed jamb frame 1. More particularly, the damping element 7 includes a first portion or zone that is clamped between the rectangular sectional tube 6 and shank 1V, and a second edge or rim zone 8 that protrudes from between the rectangular sectional tube 6 and the shank 1V and extends at an oblique angle toward the interior side of the building. This damping element 7 is preferably embodied as a sheetmetal strip that extends longitudinally along the rectangular sectional tube 6.

A U-sectional profile member 9 has several holding or mounting brackets or plates H distributed therealong in the longitudinal direction and welded thereto. The holding plates or brackets H in turn, are anchored by screws or bolts 11 and bolt anchors 12 into holes 13 bored in the masonry wall 14, so as to thereby secure the U-sectional profile member 9 to the masonry wall 14. A space in the manner of a U-sectional channel or groove is formed within the U-sectional profile member 9, between two protruding legs or flange webs thereof. The above described rectangular sectional tube 6 and the protruding edge zone or rim 8 of the damping element 7 are received in this space, whereby the free protruding edge of the edge zone or rim 8 of the damping element 7 is braced against an inner surface of one of the legs or flange webs of the U-sectional profile member 9.

In order to achieve a visually attractive appearance and construction, the sill or boundary surface L of the masonry wall 14 onto which the mounting brackets or plates H are secured by the bolts or screws 11, is covered by a finish coat 15 of plaster or mortar or the like, or by a suitable trim molding. This finish coat generally forms a trim cover 15 that is flush with the upper edge of the U-sectional profile member 9, and thereby covers and hides from sight the mounting brackets H as well as the heads of the screws 11. Thus, the exterior and interior views of the building closure according to the invention generally correspond to the appearance of a conventional window comprising a conventional fixed jamb frame and movable sash frame. The inventive components and arrangement are compact and hidden from view.

In the event of an explosion outside of the building equipped with the inventive building closure 10, the pressure forces of the explosive blast pressure wave will be directed in the direction of the arrows 16 onto the filler panel 3 as well as the fixed jamb frame 1 and the movable sash frame 2 of the building closure 10. If the building closure 10, e.g. the window 10, is closed, that is to say the movable sash frame 2 is closed and latched against the fixed jamb frame 1, then the pressure forces will entirely be transmitted through the two oppositely located vertical shanks or stiles 1V of the jamb frame 1 into the rectangular sectional profile member or tube 6 forming the mounting part of the frame arrangement. At this point, the forces will all be exerted through the damping element 7, and particularly through its rim or edge zone 8 against the inner surface of a vertical shank of the U-sectional profile member 9 which faces the small free space between the rectangular sectional tube 6 and this vertical shank of the U-sectional profile member 9. The rim or edge zone 8 of the damping element 7 is the only component that bridges this free space or gap, and thereby is the only component that initially braces and transmits the forces from the frame construction against the U-sectional profile member 9.

If the introduced force exceeds a certain level, then the rim or edge zone 8 of the sheetmetal strip forming the damping element 7 begins to be plastically deformed by plastic bending thereof, whereby the entire window including the frames 1 and 2 and the filler panel 3 is moved or shifted in the direction of the arrows 16 corresponding to the direction of the pressure acting on the window. If the pressure and thus the forces pushing the window in this inward direction are large enough, then the deformable rim or edge zone 8 will be plastically bent substantially at a right angle downward, and the rectangular sectional profile member or tube 6 will then be pressed with this bent rim 8 directly against the right vertical shank of the U-sectional profile member 9. The further movement of the window construction is thus stopped, the damping effect has been fully used up, and any possible further forces that are still applied to the window construction will be directly transmitted from the rectangular sectional member 6 rigidly into the U-sectional member 9 and from there through the mounting brackets H and the screws or bolts 11 into the masonry wall 14. The U-sectional member 9 and the brackets H thereby together form a mounting arrangement that cooperates with the mounting part 6, to receive the forces therefrom and introduce the forces into the building wall 14.

The purpose and effect of the plastically deformable rim 8 of the damping element 7 is thus to absorb and damp the peak pressure forces that arise during an explosive blast, so that these peak pressure forces do not break the glass filler panel 3, the frames 1 and 2, or the latching mechanism between the frames. The illustrated embodiment of a window makes it possible to safely absorb and withstand pressure loads of up to approximately 3 bar arising from an explosive blast. By suitably selecting the thickness and the material of the sheetmetal strip forming the damping element 7, as well as the length of the bendable rim or edge zone 8 and the maximum possible displacement distance, the maximum energy that can be absorbed by this window mounting arrangement can be varied and selected as needed for the particular application and the intended degree of explosion resistance.

Figure 3:
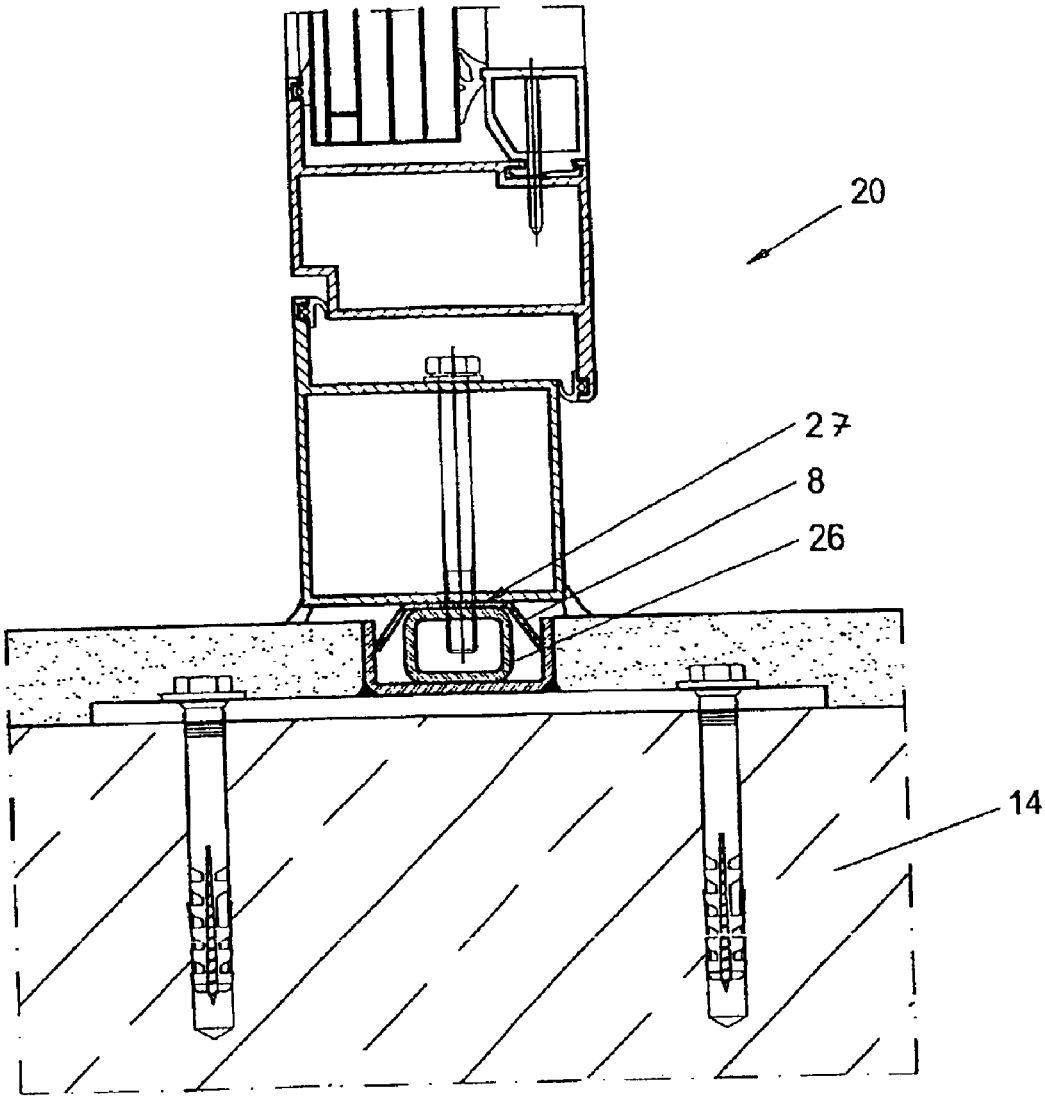
FIG. 3 is a sectional view similar to FIG. 2, but showing a second embodiment with damping elements that are effective in two opposite force introduction directions.

The second embodiment of a building closure 20 as shown in FIG. 3 corresponds with all of the characteristics and features of the building closure 10 according to FIGS. 1 and 2, except that the rectangular sectional profile member 26 is narrower than the corresponding member 6 of FIG. 2, and the damping element 27 has not only one but rather two plastically deformable rims or edge zones 8 respectively along two opposite sides or edges thereof. Therefore, with such a two-sided construction of the damping element 27, the present building closure 20 achieves a two-directional energy absorption and damping effect. Namely, the plastically deformable rim or edge zone 8 on the right side in FIG. 3 carries out the same function as described above in connection with FIG. 2, namely to absorb and damp energy from the positive pressure wave of an explosion. Furthermore, the deformable rim or edge zone 8 on the left side of the damping element 27 in FIG. 3 provides a similar energy absorption and damping for the reflection of the positive pressure wave, which creates a negative pressure and thus applies a force pulling the building closure 20 back toward the left relative to the masonry wall 14. In this manner, the two-sided damping element 27 provides energy absorption and damping to resist damage both from the positive pressure wave as well as the negative reflection wave.

Figure 4:
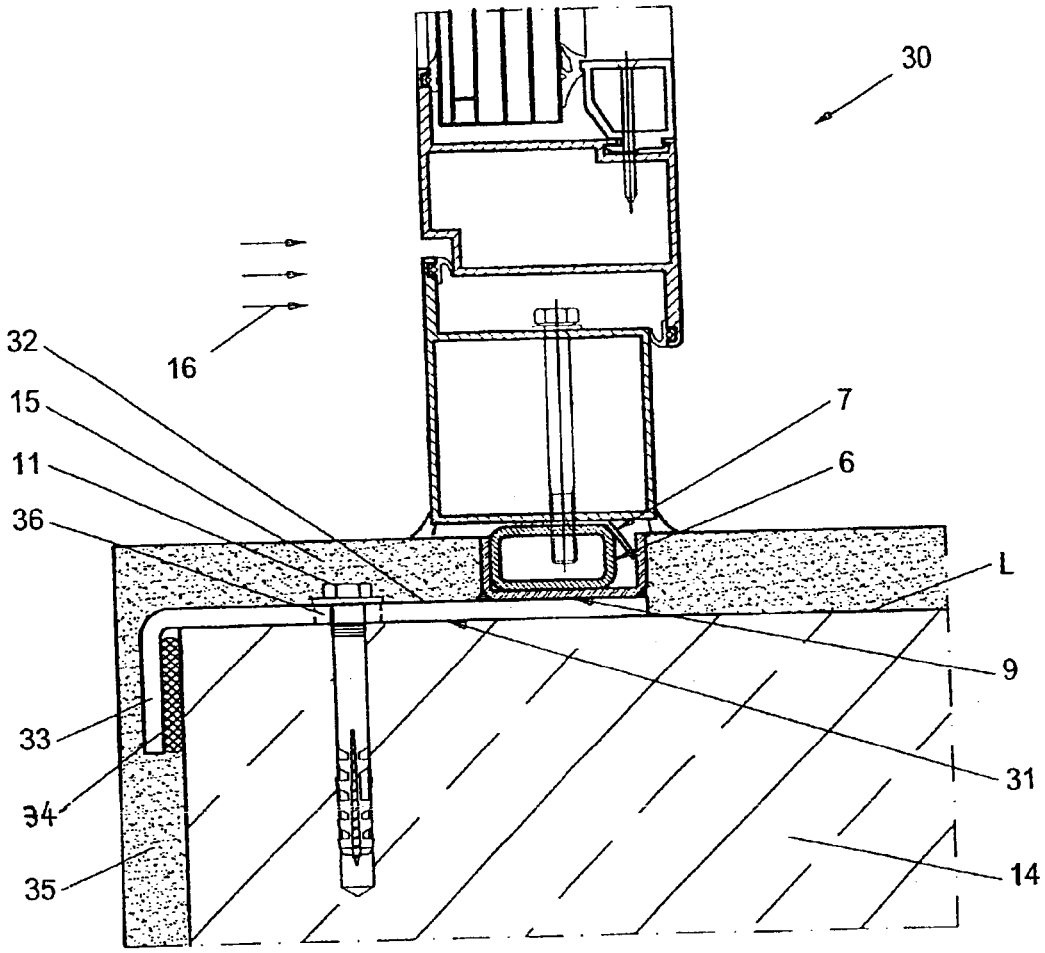
FIG. 4 is a sectional view similar to that of FIG. 2, but showing a third embodiment including a one-sided mounting or holding bracket.

Now turning to FIG. 4, the third embodiment of a building closure 30 generally corresponds to the first embodiment of FIGS. 1 and 2, except for a different configuration and mounting of the mounting brackets. Namely, in the arrangement according to FIG. 4, the building closure 30 is mounted and secured by means of right-angled holding or mounting brackets 31, which are welded to the U-sectional profile member 9. Each one of the brackets 31 comprises a tension leg or shank 32 that extends substantially parallel to and directly or proximately along the sill L or boundary surface of the masonry wall 14, as well as a support leg or shank 33 that extends at a right angle relative to the tension shank 32. The support shank 33 essentially hooks around the corner at which the sill L meets the front exterior face 35 of the masonry wall 14, and is braced against this front exterior wall face 35 through a further damping element 34, for example made of an elastomeric synthetic polymer foam, such as foam or sponge rubber 34.

Furthermore, each mounting bracket 31 is secured by a screw or bolt 11 that passes through an elongated slot hole 36 in the tension leg or shank 32 of the bracket 31. The screw or bolt 11 is fastened, for example using a bolt anchor, in a hole bored in the masonry wall 14, and thereby prevents the bracket 31 from pulling away from the wall 14 (in a direction parallel to the axis of the screw 11) and from moving along the wall, while allowing the bracket to move perpendicularly to the wall (i.e. longitudinally along the length of the tension shank 32 within the range of the elongated slot hole 36).

For visual reasons, once again the sill L as well as the adjoining exterior side 35 of the wall 14 are covered with a finish coat 15 of plaster or mortar or the like, or a trim molding or cover, which invisibly hides and covers the mounting brackets 31 as well as their securing elements. The resulting finished appearance is that of a typical conventional window and window frame, from both the exterior and the interior view.

In the event an explosion or the like exerts a great pressure and thus a great force in the direction of the arrows 16 against the building closure 30, then a damped displacement or shifting of the window arrangement toward the right in the direction of arrows 16 will occur through the plastic deformation of the rim or edge zone of the damping element 7, similarly as described above in connection with FIG. 2. Namely, this will allow a relative movement of the rectangular sectional profile member 6 with respect to the U-sectional profile member 9 in connection with a plastic deformation of the damping element 7. As soon as the maximum displacement distance has been used up, i.e. when the rectangular sectional profile member or tube 6 and the deformed portion of the damping element 7 are stopped directly against the vertical shank or web of the U-sectional member 9, the further remaining forces will be introduced from the profile member 9 into the brackets 31. At this point, each bracket 31 will shift or slide slightly toward the right in FIG. 4, as permitted by the elongated slot hole 36 cooperating with the screw or bolt 11, while the secondary damping element 34 is compressed against the external surface 35 of the masonry wall 14, thereby absorbing additional energy.

The dimensions and characteristics of the secondary damping element 34 and of the elongated slot hole 36 can be selected so that the screw or bolt 11 comes to contact directly against the end of the elongated slot hole 36 when the secondary damping element 34 has been maximally compressed. At this point, any remaining forces being transmitted through the bracket 31 are transmitted directly into the masonry wall 14 by the screw or bolt 11 and by the support shank 33 compressing the secondary damping element 34 against the exterior surface 35 of the wall 14. By providing a suitably large dimensioning (e.g. width) and number of the support shanks 33, i.e. of the mounting brackets 31, the force introduction into the masonry wall 14 can thus be uniformly distributed over a large area, so as to avoid an essentially point-wise load introduction with load peaks in the wall 14, as occurs to some extent by the anchoring of the mounting brackets H according to FIGS. 2 and 3. For this reason, the construction according to FIG. 4 is especially suitable for masonry walls or other walls having a relatively low load bearing capacity, such as old masonry walls or walls of hollow bricks or concrete blocks of more recent construction.

Figure 5:
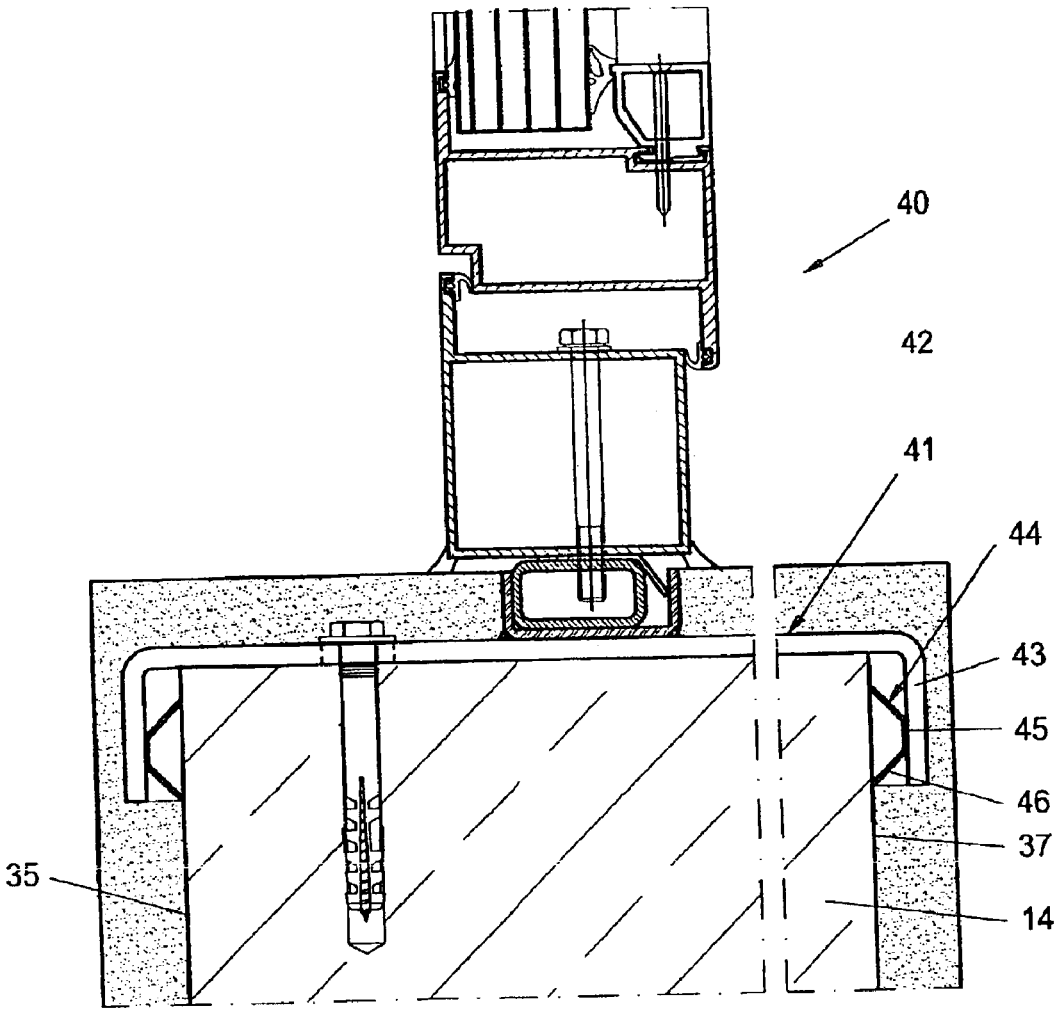
FIG. 5 is a sectional view similar to that of FIG. 4, but showing a fourth embodiment having a two-sided mounting or holding bracket.

The varied embodiment of a building closure 40 shown in FIG. 5 generally corresponds to the embodiment shown and discussed above in connection with FIG. 4, except that the mounting brackets 41 are now U-shaped, i.e. having two support legs or shanks 43 at opposite ends thereof, respectively braced by associated damping elements 44 against the exterior surface 35 and the interior surface 37 of the masonry wall 14. In this embodiment, the damping elements 44 are embodied as trough-shaped sheetmetal strips that each respectively have a middle portion 45 braced and preferably secured against the supporting shank 43, and two obliquely protruding legs 46 of which the free ends are braced against the respective associated exterior or interior wall surface 35 or 37.

The energy absorption by the damping elements 44 is achieved through the plastic deformation of the obliquely protruding legs 46. Due to the two-sided arrangement of these secondary damping elements 44 between the support shanks 43 of the brackets 41 and the facing surfaces 35 or 37 of the masonry wall 14, this damping arrangement provides an energy absorption both in the positive force direction as well as the negative force direction, i.e. both at the time of the positive pressure wave as well as the time of the negative pressure wave. This two-sided supporting bracket 41 can be used in connection with the one-sided arrangement of the damping element 7 as shown in FIG. 5, or could also be used in connection with the two-sided arrangement of the damping element 27 according to FIG. 3.

Figure 6:
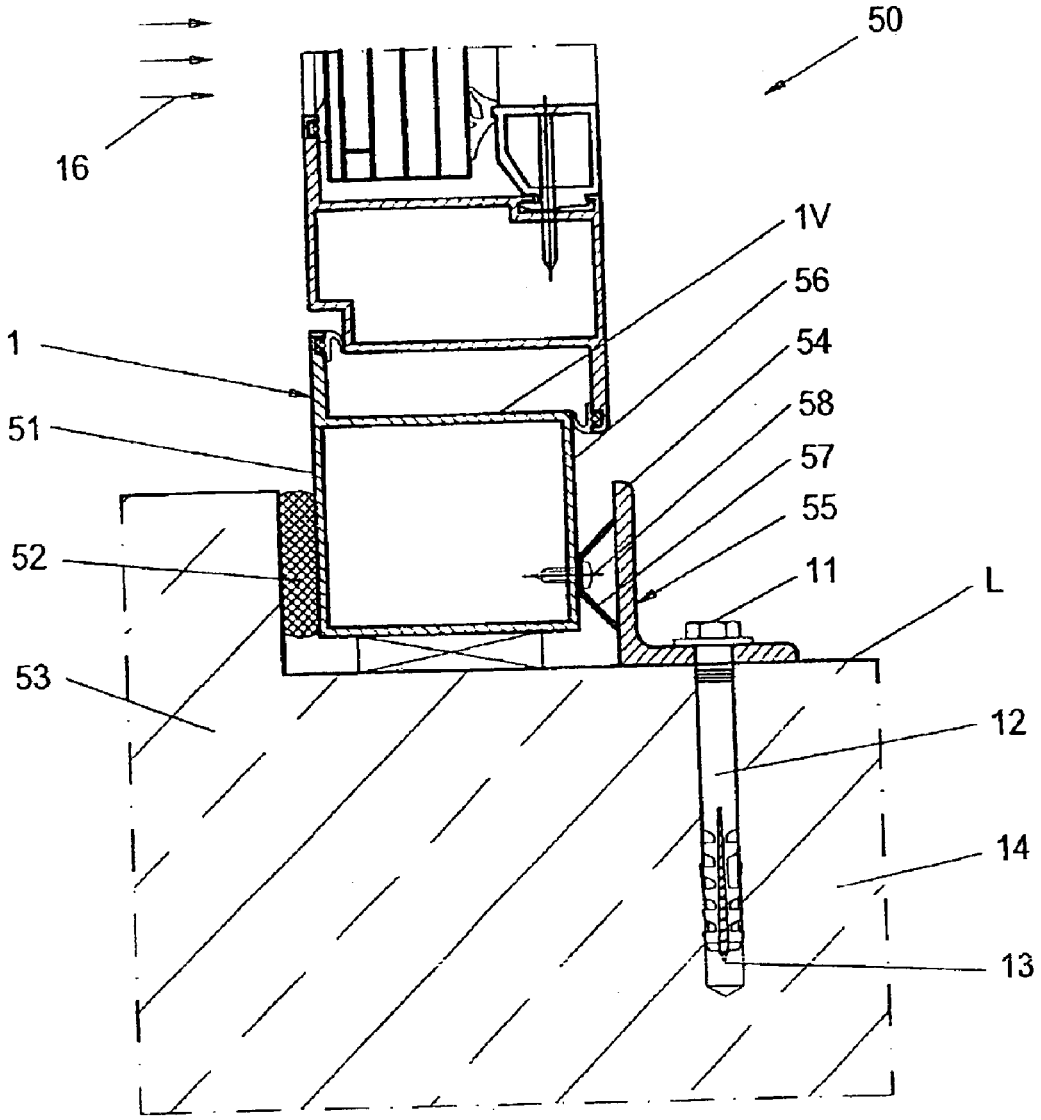
FIG. 6 is a cross-sectional view generally similar to the view of FIG. 2, but showing a fifth embodiment in which the building wall includes a shoulder that protrudes beyond the window sill into the window opening.

FIG. 6 shows a further embodiment of a building closure 50, of which an exterior surface 51 of a fixed jamb frame 1 is braced or supported through a damping element 52 in the form of an elastic or elastomeric foam or sponge rubber strip 53 against a protruding rim, shoulder or offset of the sill of the wall 14. For example, this shoulder of the sill can be formed by the exterior siding, for example a brick facing of the masonry wall 14, or by a concrete protruding rim or the like. In this arrangement, a portion of the fixed jamb frame 1 itself forms the mounting part for transmitting the forces, and the protruding sill shoulder forms a part of the mounting arrangement for introducing the forces into the building wall 14.

The pressure forces arising in the case of an explosion and acting in the direction of arrows 16 push on the window in this direction. To secure the window arrangement in this direction, an L-sectional profile member 55 extending along the entire length of the vertical shank or stile 1V of the fixed jamb frame 1 is secured by screws or bolts 11 fastened into bolt anchors 12 in holes 13 bored in the masonry wall 14. The vertically extending surface 54 of this L-sectional profile member 55 forms the countersupport surface for supporting the arising forces.

For absorbing the energy during the action of the positive pressure wave of a detonation on the window arrangement, damping elements 57 are arranged between the vertical surface 56 of the fixed jamb frame 1 and the countersupport surface 54 of the L-sectional profile member 55. These damping elements 57 consist of trough-shaped sheetmetal strips that function in the same manner as the damping elements 44 discussed in connection with FIG. 5. The damping elements 57 in the illustrated embodiment of FIG. 6 are secured by screws 58 to the vertical shanks or stiles 1V of the jamb frame 1, but could alternatively be oriented in the other direction and secured to the vertical flange web of the L-sectional profile member 55.

When the negative pressure wave acts on the window arrangement in a direction opposite the arrows 16, the window frame is pulled back toward the left, whereby the secondary damping element 52, for example embodied as a foam rubber strip or the like, achieves its energy absorption and damping effect.

Figure 7:
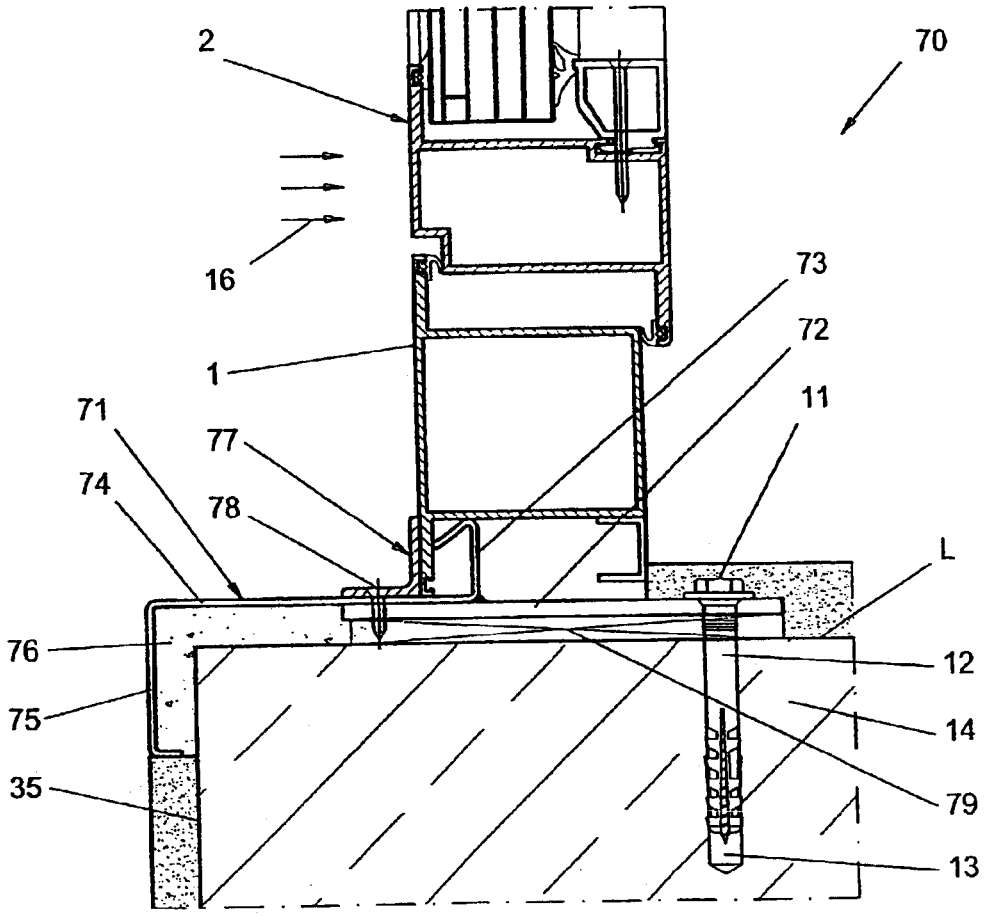
FIG. 7 is a cross-sectional view generally similar to the view of FIG. 2, but showing a sixth embodiment including a countersupport surface provided by a formed sheetmetal corner frame cover member as well as an L-sectional member.

A final further varied embodiment of a building closure 70 according to the invention is shown in FIG. 7, whereby the window construction is braced against the wall 14 from the outer side thereof by means of a corner or rim border member 71 consisting of a formed sheetmetal member. This member 71 is welded to a mounting bracket 72, which is anchored to the wall 14 by means of screws or bolts 11 and bolt anchors 12 in bored holes 13 in the wall. While the mounting brackets 72 can be secured directly against the sill or boundary surface L of the wall 14, FIG. 7 further shows the optional provision of shims 79 of hardwood or plastic or the like arranged between the mounting brackets 72 and the sill L for supporting the brackets 72 against the sill while accommodating size variations and tolerances between the building closure 70 and the sill L.

The corner or rim border member 71 includes a tension web 74, a support web 75 protruding perpendicularly therefrom at an outer end thereof, and a bent free end rim or strip 73 protruding perpendicularly from the opposite end of the tension web 74. The strip 73 includes an obliquely angled leg web that reaches up behind and bears against a protruding rim of the fixed jamb frame 1, to thereby support the window construction or building closure 70. This angled leg web of the strip 73 thus forms a damping element, while the protruding rim of the fixed jamb frame forms the mounting part.

In the event a pressure load is applied in the direction of arrows 16 to the window, the obliquely angled free end rim web of strip 73 of the border member 71 will be plastically deformed by the protruding rim of the frame 1 bearing against it. After the maximum plastic deformation of the obliquely bent free rim portion of the strip 73, remaining forces will then be transmitted through the tension web 74 and the support web 75 of the member 71 into the external side 35 of the masonry wall 14. Simultaneously, some forces will be carried through the mounting brackets 72, to be transmitted by the screws or bolts 11 directly into the masonry wall 14. A special mortar or adhesive bonding mass 76 is filled in behind the relatively thin corner or rim border member 71, whereby a bending deformation of the thin member 71 is prevented, and a sure and reliable transmission of the arising forces through the member 71 into the exterior surface 35 of the wall 14 is ensured.

The forces of the positive pressure wave are damped and absorbed, and then transmitted into the wall in the above described manner. After the reflection of the pressure wave, the building closure 70 will be pulled or displaced back toward the left by the negative pressure acting thereon. In order to limit this displacement toward the left within the window opening, an L-sectional profile member 77 is secured by screws or bolts 78 on the outer side in the corner area of the fixed jamb frame 1. The screws 78 extend through both the corner or rim border member 71 as well as the mounting brackets 72. In this embodiment, the countersupport surfaces are thus formed by the members 77 and 73.

While it is not shown, an additional damping element can be interposed between the vertical web of the L-sectional profile member 77 and the front or exterior surface of the jamb frame 1, for example in the manner of a foam rubber strip, to provide damping and energy absorption in the negative pressure application direction as well.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An explosion resistant closure arrangement of a building closure in an opening of a wall of a building, comprising:

an opening in a wall of a building, wherein said opening is bounded by a boundary surface being a jamb surface or sill surface of said wall spanning between first and second major wall surfaces of said wall;

a mounting arrangement that is connected to said wall in a force transmitting manner and that includes first and second countersupport surfaces, wherein said countersupport surfaces are located along said boundary surface within a thickness range of said wail between said first and second major wall surfaces of said wall, wherein said first countersupport surface is arranged closer to said first is major wall surface and faces toward said second major wall surface and said second countersupport surface is arranged closer to said second major wall surface and faces toward said first major wall surface, and wherein a receiving space is formed between said first and second countersupport surfaces;

a building closure that is received in said opening, and that comprises a filler panel and a frame arrangement extending along lateral edges of and carrying said filler panel, wherein said frame arrangement includes a mounting part that is received in said receiving space between said first and second countersupport surfaces; and a first damping element arranged in said receiving space between said mounting part and said first countersupport surface, wherein said first damping element comprises a plastically deformable metal element and is free to deform in said receiving space so as to damp a first force that may act an said building closure and be transmitted from said frame arrangement through said first damping element to said first countersupport surface and thence to said wall.

2. The explosion resistant closure arrangement according to claim 1, wherein said countersupport surfaces extend perpendicularly to said boundary surface.

3. The explosion resistant closure arrangement according to claim 1, wherein no damping element is arranged in said receiving space between said mounting part and said second countersupport surface.

4. The explosion resistant closure arrangement according to claim 3, wherein said mounting part bears rigidly directly against said second countersupport surface.

5. The explosion resistant closure arrangement according to claim 1, further comprising a second damping element arranged in said receiving space between said mounting part and said second countersupport surface, wherein said second damping element is deformable and is free to deform in said receiving space so as to damp a second force that is directed opposite the first force and that may act on said building closure and be transmitted from said frame arrangement through said second damping element to said second countersupport surface and thence to said wall.

6. The explosion resistant closure arrangement according to claim 5, wherein said second damping element is a deformable elastomeric element.

7. The explosion resistant closure arrangement according to claim 5, wherein said second damping element is a plastically deformable metal element.

8. The explosion resistant closure arrangement according to claim 7, wherein said first and second damping elements are integrally joined to each other as integral portions of a single damping member.

9. The explosion resistant closure arrangement according to claim 8, wherein said damping member further includes a middle portion that integrally interconnects said first and second damping elements and that is secured to said mounting part.

10. The explosion resistant closure arrangement according to claim 9, wherein said first and second damping elements and said middle portion together form a trough-shaped cross-section, with said damping elements extending respectively at an oblique angle from said middle portion.

11. The explosion resistant closure arrangement according to claim 10, wherein said frame arrangement further includes a frame, said mounting part is secured to a lateral side of said frame, and said middle portion of said damping member is received and clampedly held between said mounting part and said lateral side of said frame.

12. The explosion resistant closure arrangement according to claim 1, wherein said plastically deformable metal element comprises a plastically deformably bendable sheetmetal strip extending longitudinally along a longitudinal extension direction of said mounting part.

13. The explosion resistant closure arrangement according to claim 12, wherein said sheetmetal strip has a first deformable web portion with a cross-sectional width that extends obliquely between said mounting part and said first countersupport surface.

14. The explosion resistant closure arrangement according to claim 13, wherein said frame arrangement further includes a frame, said mounting part is secured to a lateral side of said frame, and said sheetmetal strip further includes a securing portion that is received and clampedly held between said mounting part and said lateral side of said frame.

15. The explosion resistant closure arrangement according to claim 13, wherein said sheetmetal strip further has a second deformable web portion with a cross-sectional width that extends obliquely between said mounting part and said first countersupport surface at a non-parallel angle diverging from said first deformable web portion.

16. The explosion resistant closure arrangement according to claim 1, wherein said plastically deformable metal element is a plastically deformable metal strip integrally joined to and protruding from said first countersupport surface, and extending obliquely toward and bearing against said mounting part.

17. The explosion resistant closure arrangement according to claim 1, wherein said frame arrangement includes a fixed frame, and said mounting part is an integral unitary portion of said fixed frame.

18. The explosion resistant closure arrangement according to claim 1, wherein said frame arrangement includes a fixed frame, and said mounting part is a sectional member that is releasably and separably secured to said fixed frame.

19. The explosion resistant closure arrangement according to claim 1, wherein said mounting arrangement comprises a U-sectional member arranged on said boundary surface and having two opposite flange webs of which mutually facing inwardly directed surfaces are said first and second countersupport surfaces.

20. An explosion resistant closure arrangement of a building closure in an opening of a wall of a building, comprising:

an opening in a wall of a building, wherein said opening is bounded by a boundary surface being a jamb surface or sill surface of said wall spanning between first and second major wall surfaces of said wall;

a mounting arrangement that is connected to said wall in a force transmitting manner and that includes first and second countersupport surfaces, wherein said countersupport surfaces are located along said boundary surface within a thickness range of said wall between said first and second major wall surfaces of said wall, wherein said first countersupport surface is arranged closer to said first major wall surface and faces toward said second major wall surface and said second countersupport surface is arranged closer to said second major wall surface and faces toward said first major wall surface, and wherein a receiving space is formed between said first and second countersupport surfaces;

a building closure that is received in said opening, and that comprises a filler panel and a frame arrangement extending along lateral edges of and carrying said filler panel, wherein said frame arrangement includes a mounting part that is received in said receiving space between said first and second countersupport surfaces; and a first damping element arranged in said receiving space between said mounting part and said first countersupport surface, wherein said first damning element is deformable and is free to deform in said receiving space so as to damp a first force that may act on said building closure and be transmitted from said frame arrangement through said first damning element to said first countersupport surface and thence to said wall;

wherein said mounting arrangement comprises plural L-sectional members that are arranged on said boundary surface in succession longitudinally along a longitudinal extension direction of said mounting part, with L-sectional profiles of successive ones of laid L-sectional members oriented alternatingly in opposite directions facing alternately toward said first major wall surface or toward said second major wall surface, wherein side surfaces of protruding flange webs of alternate ones of said L-sectional members respectively are said first and second countersupport surfaces.

21. An explosion resistant closure arrangement of a building closure in an opening of a wall of a building, comprising:

an opening in a wall of a building, wherein said opening is bounded by a boundary surface being a jamb surface or sill surface of said wall spanning between first and second major wall surfaces of said wall;

a mounting arrangement that is connected to said wall in a force transmitting manner and that includes first and second countersupport surfaces, wherein said countersupport surfaces are located along said boundary surface within a thickness range of said wall between said first and second major wall surfaces of said wall, wherein said first countersupport surface is arranged closer to said first major wall surface and faces toward said second major wall surface and said second countersupport surface is arranged is closer to said second major wall surface and faces toward said first major wall surface, and wherein a receiving space is formed between said first and second countersupport surface;

a building closure that is received in said opening, and that comprises a filler panel and a frame arrangement extending along lateral edges of and carrying said filler panel, wherein said frame arrangement include a mounting part that is received in said receiving space between said first and second countersupport surfaces; and a first damping element arranged in said receiving space between said mounting part and said first countersupport surface, wherein said first damping element is deformable and is free to deform in said receiving space so as to damp a first farce that may act on said building closure and be transmitted from said frame arrangement through said first damping element to said first countersupport surface and thence to said wall;

wherein said mounting arrangement comprises a shoulder of said wall protruding into said opening from said boundary surface and a sectional member secured onto said boundary surface, wherein said countersupport surfaces are opposite surfaces of said shoulder and said sectional member mutually facing each other.

22. An explosion resistant closure arrangement of a building closure in an opening of a wall of a building, comprising:

an opening in a wall of a building, wherein said opening is bounded by a boundary surface being a jamb surface or sill surface of said wall spanning between first and second major wall surface of said wall;

a mounting arrangement that is connected to said wall in a force transmitting manner and that includes first and second countersupport surfaces, wherein said countersupport surfaces are located along said boundary surface within a thickness range of said wall between said first and second major wall surfaces of said wall, wherein said first countersupport surface is arranged closer to said first major wall surface and faces toward said second major wall surface and said second countersupport surface is arranged closer to said second major wall surface and faces toward said first major wall surface, and wherein a receiving space is formed between said first and second countersupport surfaces;

a building closure that is received in said opening, and that comprises a filler panel and a frame arrangement extending along lateral edges of and carrying said filler panel, wherein said frame arrangement includes a mounting part that is received in said receiving space between said first and second countersupport surfaces; and a first damping element arranged in said receiving space between said mounting part and said first countersupport surface, wherein said first damping element is deformable and is free to deform in said receiving space so as to damp a first force that may act on said building closure and be transmitted from said frame arrangement through said first damping element to said first countersupport surface and thence to laid wall;

wherein said mounting arrangement comprises a sectional member secured on said boundary surface and a unitary integral formed sheetmetal member including a tension web extending along said boundary surface, a support web protruding from said tension web and extending along and being supported on one of said major wall surfaces, and a countersupport web protruding from said tension web opposite said support web in a direction protruding into said opening from said boundary surface, wherein said countersupport surfaces are opposite surfaces of said sectional member and of said countersupport web mutually facing each other.

23. An explosion resistant closure arrangement of a building closure in an opening of a wall of a building, comprising:

an opening in a wall of a building, wherein said opening is bounded by a boundary surface being a jamb surface or sill surface of said wall spanning between first and second major wall surfaces of said wall;

a mounting arrangement that is connected to said wall in a force transmitting manner and that includes first and second countersupport surfaces, wherein said countersupport surfaces are located along said boundary surface within a thickness range of said wall between said first and second major wall surfaces of said wall, wherein said first countersupport surface is arranged closer to said first major wall surface and faces toward said second major wall surface and said second countersupport surface is arranged closer to said second major wall surface and faces toward said first major wall surface, and wherein a receiving space is formed between said first and second countersupport surfaces;

a building closure that is received in said opening, and that comprises a filler panel and a frame arrangement extending along lateral edges of and carrying said filler panel, wherein said frame arrangement includes a mounting part that is received in said receiving space between said first and second countersupport surfaces; and a first damping element arranged in said receiving space between said mounting part and said first countersupport surface, wherein said first damping element is deformable and is free to deform in said receiving space so as to damp a first force that may act on said building closure and be transmitted from said frame arrangement through said first damping element to said first countersupport surface and thence to said wall;

wherein said mounting arrangement comprises at least one sectional member forming at least one of said countersupport surfaces and a plurality of mounting brackets onto which said sectional member is connected, and wherein said mounting brackets are mounted on said boundary surface and securely anchored to said wall.

24. The explosion resistant closure arrangement according to claim 23, wherein each one of said mounting brackets respectively comprises a tension shank extending along and proximate to said boundary surface and a first support shank that protrudes from said tension shank and extends along and is supported against one of said major wall surfaces.

25. The explosion resistant closure arrangement according to claim 24, further comprising a deformable secondary damping element interposed between said first support shank and said one of said major wall surfaces.

26. The explosion resistant closure arrangement according to claim 24, wherein each one of said mounting brackets respectively further comprises a second support shank that protrudes from said tension shank at an end thereof opposite said first support shank, and that extends along and is supported against another of said major wall surfaces.

* * * * *

UNITED STATES PATENT AND TRADEMARK OFFICE

CERTIFICATE OF CORRECTION

PATENT NO. : 6,922,957 B2
DATED : August 2, 2005
INVENTOR(S) : Saelzer

It is certified that error appears in the above-identified patent and that said Letters Patent is hereby corrected as shown below:

Column 13,
Line 13, before “between” replace “wail” by -- wall --,
Line 16, before “major” delete “is”,
Line 34, before “said” replace “an” by -- on --, Column 15,
Lines 21 and 25, before “element” replace “damning” by -- damping --,
Line 31, after “ones of” replace “laid” by -- said --,
Line 54, before “closer” delete “is”,
Line 57, after “countersupport” replace “surface;” by -- surfaces; --,
Line 61, after “arrangement” replace “include” by -- includes --, Column 16,
Line 2, after “first” replace “farce” by -- force --,
Line 17, before “of said” replace “surface” by -- surfaces --,
Line 46, before “wall” replace “laid” by -- said --.

Signed and Sealed this

Tenth Day of January, 2006

JON W. DUDAS
*Director of the United States Patent and Trademark Office*